US009863201B2

(12) United States Patent
Fripp et al.

(10) Patent No.: US 9,863,201 B2
(45) Date of Patent: Jan. 9, 2018

(54) ISOLATION DEVICE CONTAINING A DISSOLVABLE ANODE AND ELECTROLYTIC COMPOUND

(71) Applicant: Halliburton Energy Services, Inc., Houston, TX (US)

(72) Inventors: Michael L. Fripp, Carrollton, TX (US); Zachary W. Walton, Carrollton, TX (US); Zachary R. Murphree, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/469,918

(22) Filed: Mar. 27, 2017

(65) Prior Publication Data

US 2017/0198539 A1 Jul. 13, 2017

Related U.S. Application Data

(63) Continuation of application No. 14/154,596, filed on Jan. 14, 2014, now Pat. No. 9,777,549, which is a (Continued)

(51) Int. Cl.

| | |
|---|---|
| ***E21B 29/00*** | (2006.01) |
| ***E21B 29/02*** | (2006.01) |
| ***E21B 33/12*** | (2006.01) |

(52) U.S. Cl.

CPC ..... *E21B 29/02* (2013.01); *E21B 29/00* (2013.01); *E21B 33/1208* (2013.01)

(58) Field of Classification Search

CPC ..... E21B 29/00

See application file for complete search history.

(56) References Cited

U.S. PATENT DOCUMENTS

| | | | |
|---|---|---|---|
| 3,876,471 | A | 4/1975 | Jones |
| 4,573,517 | A | 3/1986 | Booth et al. |

(Continued)

FOREIGN PATENT DOCUMENTS

| | | | |
|---|---|---|---|
| CA | 2857123 | A1 | 6/2013 |
| EP | 2354436 | A2 | 8/2011 |

(Continued)

OTHER PUBLICATIONS

Patent Office of the Cooperation Council for the Arab States of the Gulf, Examination Report, Application No. GC2013-24222, dated Aug. 18, 2016.

(Continued)

*Primary Examiner* — Jennifer H Gay
*Assistant Examiner* — Steven A MacDonald
(74) *Attorney, Agent, or Firm* — McGuire Woods LLP

(57) ABSTRACT

A wellbore isolation device comprising: a first material, wherein the first material: (A) is a metal or a metal alloy; and (B) partially dissolves when an electrically conductive path exists between the first material and a second material and at least a portion of the first and second materials are in contact with an electrolyte; and an electrolytic compound, wherein the electrolytic compound dissolves in a fluid located within the wellbore to form free ions that are electrically conductive. A method of removing the wellbore isolation device comprises: placing the wellbore isolation device into the wellbore; and allowing at least a portion of the first material to dissolve.

13 Claims, 2 Drawing Sheets

Related U.S. Application Data continuation-in-part of application No. PCT/US2013/027531, filed on Feb. 23, 2013, which is a continuation of application No. 13/491,995, filed on Jun. 8, 2012, now Pat. No. 8,905,147.

(56) References Cited

U.S. PATENT DOCUMENTS

| | | | |
|---|---|---|---|
| 5,570,502 | A | 11/1996 | Sawtell et al. |
| 5,578,255 | A | 11/1996 | Okuyama et al. |
| 7,077,200 | B1 | 7/2006 | Adnan et al. |
| 7,350,582 | B2 | 4/2008 | McKeachnie |
| 7,699,101 | B2 | 4/2010 | Fripp |
| 7,708,937 | B2 | 5/2010 | Meng et al. |
| 7,798,236 | B2 | 9/2010 | McKeachnie |
| 8,211,248 | B2 | 7/2012 | Marya |
| 8,413,727 | B2 | 4/2013 | Holmes |
| 8,424,610 | B2 | 4/2013 | Newton |
| 8,573,295 | B2 | 11/2013 | Johnson |
| 2004/0045715 | A1 | 3/2004 | Stoesz et al. |
| 2005/0205265 | A1 | 9/2005 | Todd |
| 2007/0089877 | A1 | 4/2007 | Corre et al. |
| 2007/0107908 | A1 | 5/2007 | Vaidya |
| 2007/0181224 | A1 | 8/2007 | Marya |
| 2008/0066924 | A1 | 3/2008 | Xu |
| 2008/0149351 | A1 | 6/2008 | Marya et al. |
| 2008/0175744 | A1 | 7/2008 | Motegi et al. |
| 2008/0249637 | A1 | 10/2008 | Asgari |
| 2009/0025940 | A1 | 1/2009 | Rytlewski |
| 2009/0101334 | A1 | 4/2009 | Baser |
| 2010/0270031 | A1 | 10/2010 | Patel |
| 2010/0294510 | A1 | 11/2010 | Holmes |
| 2011/0132619 | A1 | 6/2011 | Agrawal |
| 2011/0132621 | A1 | 6/2011 | Agrawal |
| 2011/0136707 | A1 | 6/2011 | Xu et al. |
| 2011/0186306 | A1 | 8/2011 | Marya et al. |
| 2012/0118583 | A1 | 5/2012 | Johnson |
| 2012/0175109 | A1 | 7/2012 | Richard |
| 2012/0273229 | A1 | 11/2012 | Xu et al. |
| 2012/0285692 | A1 | 11/2012 | Potapenko et al. |
| 2012/0318513 | A1 | 12/2012 | Mazyar |
| 2013/0032357 | A1 | 2/2013 | Mazyer |
| 2013/0081814 | A1 | 4/2013 | Gaudette |
| 2013/0133897 | A1 | 5/2013 | Baihly |
| 2013/0146302 | A1 | 6/2013 | Gaudette |
| 2013/0153236 | A1 | 6/2013 | Bishop |
| 2013/0206425 | A1 | 8/2013 | Mazyar |
| 2013/0209175 | A1 | 8/2013 | Keyworth |
| 2013/0240200 | A1 | 9/2013 | Frazier |
| 2013/0269932 | A1 | 10/2013 | Dams |
| 2013/0300066 | A1 | 11/2013 | Xu et al. |
| 2013/0327540 | A1 | 12/2013 | Hamid |
| 2013/0333899 | A1 | 12/2013 | Xu |
| 2014/0027128 | A1 | 1/2014 | Johnson |
| 2014/0196899 | A1 | 7/2014 | Jordan et al. |

FOREIGN PATENT DOCUMENTS

| | | | |
|---|---|---|---|
| EP | 2118437 | B1 | 3/2012 |
| WO | 2007141465 | A1 | 12/2007 |
| WO | 2011017047 | A1 | 2/2011 |
| WO | 2012091984 | A2 | 7/2012 |
| WO | 2013019409 | A2 | 2/2013 |
| WO | 2013022635 | A3 | 2/2013 |
| WO | 2013089941 | A1 | 6/2013 |
| WO | 2013122712 | A1 | 8/2013 |

OTHER PUBLICATIONS

Australian Patent Office, Patent Examination Report No. 1, Australian Application No. 2015248171, dated Sep. 6, 2016.

Australian Patent Office, Patent Examination Report No. 1, Australian Application No. 2014377594, dated Jul. 21, 2016.

European Patent Office, Communication, European Extended Search Report, Application No. 13801386.7, dated May 30, 2016.

Australian Government IP Australia, Patent Examination Report No. 2, Appln. No. 2013272271, dated Apr. 29, 2016.

T. Tanski, Synergy effect of heat and surface treatment on properties of the Mg—Al—Zn cast alloys, Journal of Achievements in Materials and Manufacturing Engineering, Oct. 2012, p. 260-274, vol. 54, Issue 2, Silesian University of Technology, Giliwice, Poland.

Degradable Casing Perforation Ball Sealers and Methods for Use in Well Treatment, IPCOM000215741D, Mar. 7, 2012. Available at: http://priorartdatabase.com/IPCOM/000215741.

Solu-Plugs—Delayed Frac Plugs, IPCOM000176055D, Nov. 3, 2008. Available at: http://www.ip.com/pubview/IPCOM000176055D.

International Search Report and Written Opinion date dated Mar. 31, 2015; PCT International Application No. PCT/US2014/068438.

International Written Opinion dated May 27, 2015; PCT International Application No. PCT/US2015/014981.

International Search Report and Written Opinion dated May 19, 2015; PCT International Application No. PCT/US2015/014988.

Australian Patent Office, Patent Examination Report No. 2, Australian Application No. 2014377594, dated Sep. 29, 2016.

European Patent Office, Communication, European Extended Search Report, Application No. 14878579.3, dated Jun. 3, 2016.

International Search Report and Written Opinion dated Mar. 19, 2015; PCT International Application No. PCT/US2014/068372.

Australian Patent Office, Patent Examination Report No. 1, Australian Application No. 2014385212, dated Jul. 14, 2016.

Australian Government IP Australia, Patent Examination Report No. 1, Appln. No. 2014385213, dated Aug. 11, 2016.

Australian Government IP Australia, Patent Examination Report No. 2, Appln. No. 2014385213, dated Oct. 12, 2016.

Patent Cooperation Treaty, International Search Report and Written Opinion dated Mar. 19, 2015; PCT International Application No. PCT/US2014/068442.

Canadian Intellectual Property Office, Office Action, Appln. 2,868,885, dated Jan. 20, 2016.

Canadian Intellectual Property Office, Office Action, Appln. 2,868,885, dated Oct. 27, 2016.

Patent Office of the Cooperation Council for the Arab States of the Gulf, First Examination Report, Appln. No. GC 2013-24222, dated Jun. 12, 2016.

Patent Cooperation Treaty, International Preliminary Report on Patentability, PCT International Appln. No. PCT/US2013/027531, dated Dec. 9, 2014.

Canadian Intellectual Property Office, Office Action, Appln. 2,868,885, dated Mar. 15, 2017.

European Patent Office, Communication (extended European search report, European Application No. 14878579.3, dated Apr. 25, 2017.

European Patent Office, Communication, European Extended Search Report, Application No. 14884707.2, dated Jun. 29, 2017.

Canadian Intellectual Property Office, Office Action, Application No. 2,933,023, dated May 31, 2017.

European Patent Office, Communication, European Application No. 13801386.7, dated Dec. 12, 2016.

Canadian Intellectual Property Office, Office Action, Canadian Appln. No. 2,927,400, dated Apr. 28, 2017.

Canadian Intellectual Property Office, Office Action, Canadian Appln. No. 2,930,970, dated May 1, 2017.

Australian Government, Patent Exam. No. 1, Australian Appln. No. 2013272271, dated Aug. 26, 2015.

European Patent Office, Communication, European Extended Search Report, Application No. 15780083.0, dated Oct. 18, 2017.

ISOLATION DEVICE CONTAINING A DISSOLVABLE ANODE AND ELECTROLYTIC COMPOUND

This is a continuation application of U.S. patent application Ser. No. 14/154,596 filed Jan. 14, 2014, now allowed, which is a continuation-in-part application of PCT/US13/27531 filed Feb. 23, 2013, which is a continuation of U.S. patent application Ser. No. 13/491,996 filed Jun. 8, 2012, now issued as U.S. Pat. No. 8,905,147, the disclosures of which are incorporated by reference herein in their entirety.

TECHNICAL FIELD

Isolation devices can be used to restrict fluid flow between intervals of a wellbore. An isolation device can be removed from a wellbore after use. Methods of removing an isolation device using galvanic corrosion are provided.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
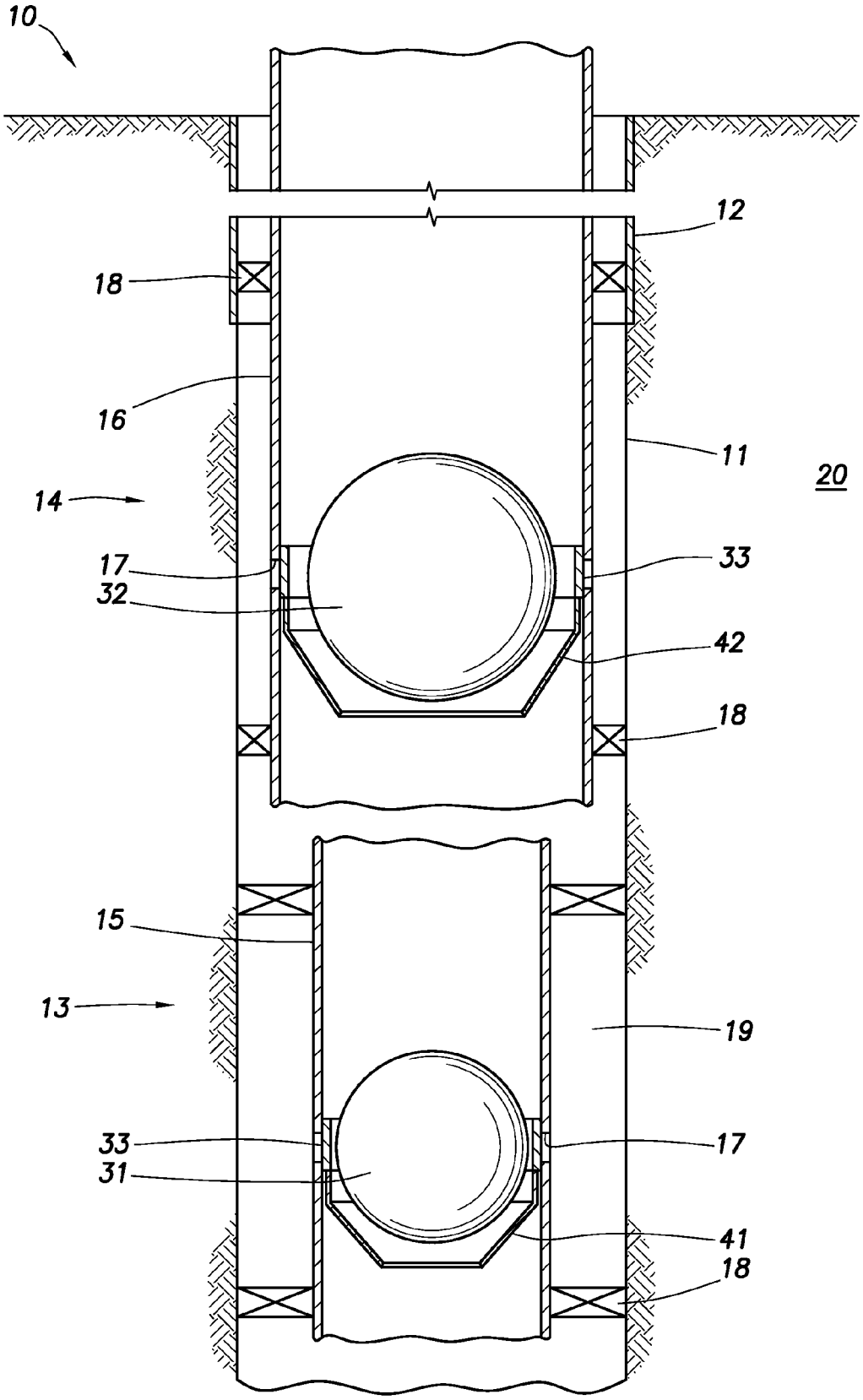
FIG. 1 is a schematic illustration of a well system containing more than one isolation device.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more materials, layers, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device. An isolation device can be used for zonal isolation and functions to block fluid flow within a tubular, such as a tubing string, or within an annulus. The blockage of fluid flow prevents the fluid from flowing into the zones located below the isolation device and isolates the zone of interest. As used herein, the relative term "below" means at a location further away from a wellhead and "above" means at a location closer to the wellhead compared to a reference object. In this manner, treatment techniques can be performed within the zone of interest.

Common isolation devices include, but are not limited to, a ball, a plug, a bridge plug, a wiper plug, and a packer. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished, for example, via a ball and seat by dropping the ball from the wellhead onto the seat that is located within the wellbore. The ball engages with the seat, and the seal created by this engagement prevents fluid communication into other zones downstream of the ball and seat. In order to treat more than one zone using a ball and seat, the wellbore can contain more than one ball seat. For example, a seat can be located within each zone. Generally, the inner diameter (I.D.) of the ball seats are different for each zone. For example, the I.D. of the ball seats sequentially decrease at each zone, moving from the wellhead to the bottom of the well. In this manner, a smaller ball is first dropped into a first zone that is the farthest downstream; that zone is treated; a slightly larger ball is then dropped into another zone that is located upstream of the first zone; that zone is then treated; and the process continues in this fashion—moving upstream along the wellbore—until all the desired zones have been treated. As used herein, the relative term "upstream" means at a location closer to the wellhead.

A bridge plug is composed primarily of slips, a plug mandrel, and a rubber sealing element. A bridge plug can be introduced into a wellbore and the sealing element can be caused to block fluid flow into downstream zones. A packer generally consists of a sealing device, a holding or setting device, and an inside passage for fluids. A packer can be used to block fluid flow through the annulus located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more zones. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device or the entire device. Yet, another way to remove an isolation device is to contact the device with a solvent, such as an acid, thus dissolving all or a portion of the device.

However, some of the disadvantages to using traditional methods to remove a retrievable isolation device include: it can be difficult and time consuming to use a retrieval tool; milling can be time consuming and costly; and premature dissolution of the isolation device can occur. For example, premature dissolution can occur if acidic fluids are used in the well prior to the time at which it is desired to dissolve the isolation device.

Galvanic corrosion can be used to dissolve materials making up an isolation device. Galvanic corrosion occurs when two different metals or metal alloys are in electrical connectivity with each other and both are in contact with an electrolyte. As used herein, the phrase "electrical connectivity" means that the two different metals or metal alloys are either touching or in close enough proximity to each other such that when the two different metals are in contact with an electrolyte, the electrolyte becomes electrically conductive and ion migration occurs between one of the metals and the other metal, and is not meant to require an actual physical connection between the two different metals, for example, via a metal wire. It is to be understood that as used herein, the term "metal" is meant to include pure metals and also metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

The metal that is less noble, compared to the other metal, will dissolve in the electrolyte. The less noble metal is often referred to as the anode, and the more noble metal is often referred to as the cathode. Galvanic corrosion is an electrochemical process whereby free ions in the electrolyte make the electrolyte electrically conductive, thereby providing a means for ion migration from the anode to the cathode—resulting in deposition formed on the cathode. Metals can be arranged in a galvanic series. The galvanic series lists metals in order of the most noble to the least noble. An anodic index lists the electrochemical voltage (V) that develops between a metal and a standard reference electrode (gold (Au)) in a given electrolyte. The actual electrolyte used can affect where a particular metal or metal alloy appears on the galvanic series and can also affect the electrochemical voltage. For example, the dissolved oxygen content in the electrolyte can dictate where the metal or metal alloy appears on the galvanic series and the metal's electrochemical voltage. The anodic index of gold is −0 V; while the anodic index of beryllium is −1.85 V. A metal that has an anodic index greater than another metal is more noble than the other metal and will function as the cathode. Conversely, the metal that has an anodic index less than another metal is less noble and functions as the anode. In order to determine the relative voltage between two different metals, the anodic index of the lesser noble metal is subtracted from the other metal's anodic index, resulting in a positive value.

There are several factors that can affect the rate of galvanic corrosion. One of the factors is the distance separating the metals on the galvanic series chart or the difference between the anodic indices of the metals. For example, beryllium is one of the last metals listed at the least noble end of the galvanic series and platinum is one of the first metals listed at the most noble end of the series. By contrast, tin is listed directly above lead on the galvanic series. Using the anodic index of metals, the difference between the anodic index of gold and beryllium is 1.85 V; whereas, the difference between tin and lead is 0.05 V. This means that galvanic corrosion will occur at a much faster rate for magnesium or beryllium and gold compared to lead and tin.

The following is a partial galvanic series chart using a deoxygenated sodium chloride water solution as the electrolyte. The metals are listed in descending order from the most noble (cathodic) to the least noble (anodic). The following list is not exhaustive, and one of ordinary skill in the art is able to find where a specific metal or metal alloy is listed on a galvanic series in a given electrolyte.

PLATINUM
GOLD
ZIRCONIUM
GRAPHITE
SILVER
CHROME IRON
SILVER SOLDER
COPPER-NICKEL ALLOY 80-20
COPPER-NICKEL ALLOY 90-10
MANGANESE BRONZE (CA 675), TIN BRONZE (CA903, 905)
COPPER (CA102)
BRASSES
NICKEL (ACTIVE)
TIN
LEAD
ALUMINUM BRONZE
STAINLESS STEEL
CHROME IRON
MILD STEEL (1018), WROUGHT IRON
ALUMINUM 2117, 2017, 2024
CADMIUM
ALUMINUM 5052, 3004, 3003, 1100, 6053
ZINC
MAGNESIUM
BERYLLIUM

The following is a partial anodic index listing the voltage of a listed metal against a standard reference electrode (gold)

using a deoxygenated sodium chloride water solution as the electrolyte. The metals are listed in descending order from the greatest voltage (most cathodic) to the least voltage (most anodic). The following list is not exhaustive, and one of ordinary skill in the art is able to find the anodic index of a specific metal or metal alloy in a given electrolyte.

Anodic index

| Metal | Index (V) |
|---|---|
| Gold, solid and plated, Gold-platinum alloy | −0.00 |
| Rhodium plated on silver-plated copper | −0.05 |
| Silver, solid or plated; monel metal. High nickel-copper alloys | −0.15 |
| Nickel, solid or plated, titanium an s alloys, Monel | −0.30 |
| Copper, solid or plated; low brasses or bronzes; silver solder; German silvery high copper-nickel alloys; nickel-chromium alloys | −0.35 |
| Brass and bronzes | −0.40 |
| High brasses and bronzes | −0.45 |
| 18% chromium type corrosion-resistant steels | −0.50 |
| Chromium plated; tin plated; 12% chromium type corrosion-resistant steels | −0.60 |
| Tin-plate; tin-lead solder | −0.65 |
| Lead, solid or plated; high lead alloys | −0.70 |
| 2000 series wrought aluminum | −0.75 |
| Iron, wrought, gray or malleable, plain carbon and low alloy steels | −0.85 |
| Aluminum, wrought alloys other than 2000 series aluminum, cast alloys of the silicon type | −0.90 |
| Aluminum, cast alloys other than silicon type, cadmium, plated and chromate | −0.95 |
| Hot-dip-zinc plate; galvanized steel | −1.20 |
| Zinc, wrought; zinc-base die-casting alloys; zinc plated | −1.25 |
| Magnesium & magnesium-base alloys, cast or wrought | −1.75 |
| Beryllium | −1.85 |

Another factor that can affect the rate of galvanic corrosion is the temperature and concentration of the electrolyte. The higher the temperature and concentration of the electrolyte, the faster the rate of corrosion. Yet another factor that can affect the rate of galvanic corrosion is the total amount of surface area of the least noble (anodic metal). The greater the surface area of the anode that can come in contact with the electrolyte, the faster the rate of corrosion. The cross-sectional size of the anodic metal pieces can be decreased in order to increase the total amount of surface area per total volume of the material. Yet another factor that can affect the rate of galvanic corrosion is the ambient pressure. Depending on the electrolyte chemistry and the two metals, the corrosion rate can be slower at higher pressures than at lower pressures if gaseous components are generated.

In order for galvanic corrosion to occur, the anode and cathode metals must be in contact with an electrolyte. As used herein, an electrolyte is any substance containing free ions (i.e., a positive- or negative-electrically charged atom or group of atoms) that make the substance electrically conductive. An electrolyte can be selected from the group consisting of, solutions of an acid, a base, a salt, and combinations thereof. A salt can be dissolved in water, for example, to create a salt solution. Common free ions in an electrolyte include sodium ($Na^+$), potassium ($K^+$), calcium ($Ca^{2+}$), magnesium ($Mg^{2+}$), chloride ($Cl^-$), hydrogen phosphate ($HPO_4^{2-}$), and hydrogen carbonate ($HCO_3^-$).

The number of free ions in the electrolyte will decrease as the galvanic reaction occurs because the free ions in the electrolyte enable the electrochemical reaction to occur between the metals by donating its free ions. At some point, the electrolyte may be depleted of free ions if there are any remaining anode and cathode metals that have not reacted. If this occurs, the galvanic corrosion that causes the anode to dissolve will stop. Moreover, an electrolyte may not be present in the wellbore to enable the galvanic reaction to proceed. Examples of this can include water- or steam-injection wells in which freshwater is needed to prevent salt or scale buildup within the pores of the subterranean formation.

Thus, there is a need for being able to control the rate of a galvanic reaction using the electrolyte. There is also a need for efficiently providing an electrolyte in wellbore operations that utilize a non-electrolyte fluid.

According to an embodiment, a wellbore isolation device comprises: a first material, wherein the first material: (A) is a metal or a metal alloy; and (B) partially dissolves when an electrically conductive path exists between the first material and a second material and at least a portion of the first and second materials are in contact with an electrolyte; and an electrolytic compound, wherein the electrolytic compound dissolves in a fluid located within the wellbore to form free ions that are electrically conductive.

According to another embodiment, a method of removing a wellbore isolation device comprises: placing the wellbore isolation device into the wellbore; and allowing at least a portion of the first material to dissolve.

Any discussion of the embodiments regarding the isolation device or any component related to the isolation device (e.g., the electrolyte) is intended to apply to all of the apparatus and method embodiments.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A first section of tubing string 15 can be installed in the wellbore 11. A second section of tubing string 16 (as well as multiple other sections of tubing string, not shown) can be installed in the wellbore 11. The well system 10 can comprise at least a first zone 13 and a second zone 14. The well system 10 can also include more than two zones, for example, the well system 10 can further include a third zone, a fourth zone, and so on. The well system 10 can further include one or more packers 18. The packers 18 can be used in addition to the isolation device to isolate each zone of the wellbore 11. The isolation device can be the packers 18. The packers 18 can be used to prevent fluid flow between one or more zones (e.g., between the first zone 13 and the second zone 14) via an annulus 19. The tubing string 15/16 can also include one or more ports 17. One or more ports 17 can be located in each section of the tubing string. Moreover, not every section of the tubing string needs to include one or more ports 17. For example, the first section of tubing string 15 can include one or more ports 17, while the second section of tubing string 16 does not contain a port. In this manner, fluid flow into the annulus 19 for a particular section can be selected based on the specific oil or gas operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

According to an embodiment, the isolation device is capable of restricting or preventing fluid flow between a first zone 13 and a second zone 14. The first zone 13 can be located upstream or downstream of the second zone 14. In this manner, depending on the oil or gas operation, fluid is restricted or prevented from flowing downstream or upstream into the second zone 14. Examples of isolation devices capable of restricting or preventing fluid flow between zones include, but are not limited to, a ball and seat, a plug, a bridge plug, a wiper plug, and a packer.

Figure 2:
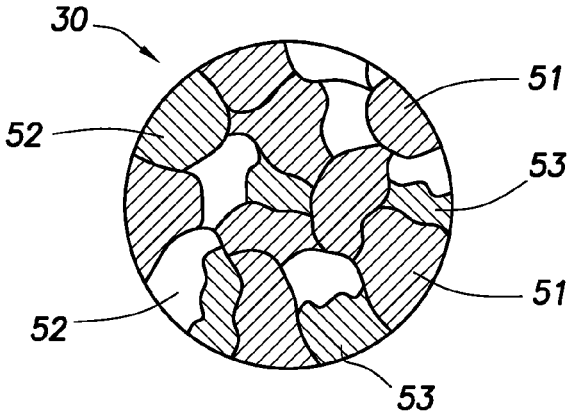
FIGS. 2-4 are schematic illustrations of an isolation device according to different embodiments.
Figure 3:
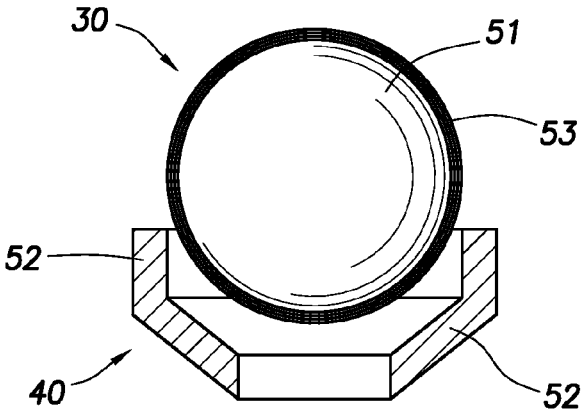
Figure 4:
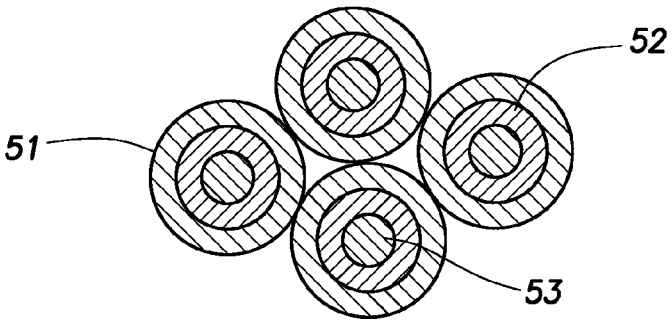

Referring to FIGS. 2-4, the isolation device comprises at least a first material 51, wherein the first material is capable of at least partially dissolving when an electrically conductive path exists between the first material 51 and a second material 52. The first material 51 and the second material 52 are metals or metal alloys. The metal or metal of the metal alloy can be selected from the group consisting of, lithium, sodium, potassium, rubidium, cesium, beryllium, magnesium, calcium, strontium, barium, radium, aluminum, gallium, indium, tin, thallium, lead, bismuth, scandium, titanium, vanadium, chromium, manganese, iron, cobalt, nickel, copper, zinc, yttrium, zirconium, niobium, molybdenum, ruthenium, rhodium, palladium, silver, cadmium, lanthanum, hafnium, tantalum, tungsten, rhenium, osmium, iridium, platinum, gold, graphite, and combinations thereof. Preferably, the metal or metal of the metal alloy is selected from the group consisting of beryllium, tin, iron, nickel, copper, zinc, and combinations thereof. According to an embodiment, the metal is neither radioactive, unstable, nor theoretical.

According to an embodiment, the first material 51 and the second material 52 are different metals or metal alloys. By way of example, the first material 51 can be nickel and the second material 52 can be gold. Furthermore, the first material 51 can be a metal and the second material 52 can be a metal alloy. The first material 51 and the second material 52 can be a metal and the first and second material can be a metal alloy. The second material 52 has a greater anodic index than the first material 51. Stated another way, the second material 52 is listed higher on a galvanic series than the first material 51. According to another embodiment, the second material 52 is more noble than the first material 51. In this manner, the first material 51 acts as an anode and the second material 52 acts as a cathode. Moreover, in this manner, the first material 51 (acting as the anode) at least partially dissolves when in electrical connectivity with the second material 52 and when the first and second materials are in contact with an electrolyte.

The methods include the step of allowing at least a portion of the first material to dissolve. At least a portion of the first material 51 can dissolve in a desired amount of time. The desired amount of time can be pre-determined, based in part, on the specific oil or gas well operation to be performed. The desired amount of time can be in the range from about 1 hour to about 2 months. There are several factors that can affect the rate of dissolution of the first material 51. According to an embodiment, the first material 51 and the second material 52 are selected such that the at least a portion of the first material 51 dissolves in the desired amount of time. By way of example, the greater the difference between the second material's anodic index and the first material's anodic index, the faster the rate of dissolution. By contrast, the less the difference between the second material's anodic index and the first material's anodic index, the slower the rate of dissolution. By way of yet another example, the farther apart the first material and the second material are from each other in a galvanic series, the faster the rate of dissolution; and the closer together the first and second material are to each other in the galvanic series, the slower the rate of dissolution. By evaluating the difference in the anodic index of the first and second materials, or by evaluating the order in a galvanic series, one of ordinary skill in the art will be able to determine the rate of dissolution of the first material in a given electrolyte.

Another factor that can affect the rate of dissolution of the first material 51 is the proximity of the first material 51 to the second material 52. A more detailed discussion regarding different embodiments of the proximity of the first and second materials is presented below. Generally, the closer the first material 51 is physically to the second material 52, the faster the rate of dissolution of the first material 51. By contrast, generally, the farther apart the first and second materials are from one another, the slower the rate of dissolution. It should be noted that the distance between the first material 51 and the second material 52 should not be so great that an electrically conductive path ceases to exist between the first and second materials. According to an embodiment, any distance between the first and second materials 51/52 is selected such that the at least a portion of the first material 51 dissolves in the desired amount of time.

As can be seen in FIG. 1, the first section of tubing string 15 can be located within the first zone 13 and the second section of tubing string 16 can be located within the second zone 14. The wellbore isolation device can be a ball, a plug, a bridge plug, a wiper plug, or a packer. The wellbore isolation device can restrict fluid flow past the device. The wellbore isolation device may be a free falling device, may be a pumped-down device, or it may be tethered to the surface. As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string. When the first section of tubing string 15 is located below the second section of tubing string 16, then the inner diameter (I.D.) of the first seat 41 can be less than the I.D. of the second seat 42. In this manner, a first ball 31 can be placed into the first section of tubing string 15. The first ball 31 can have a smaller diameter than a second ball 32. The first ball 31 can engage a first seat 41. Fluid can now be temporarily restricted or prevented from flowing into any zones located downstream of the first zone 13. In the event it is desirable to temporarily restrict or prevent fluid flow into any zones located downstream of the second zone 14, the second ball 32 can be placed into second section of tubing string 16 and will be prevented from falling into the first section of tubing string 15 via the second seat 42 or because the second ball 32 has a larger outer diameter (O.D.) than the I.D. of the first seat 41. The second ball 32 can engage the second seat 42. The ball (whether it be a first ball 31 or a second ball 32) can engage a sliding sleeve 50 during placement. This engagement with the sliding sleeve 50 can cause the sliding sleeve to move; thus, opening a port 17 located adjacent to the seat. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular zone. As such, a fluid can be produced from the subterranean formation 20 or injected into the formation.

FIGS. 2-4 depict the isolation device according to certain embodiments. As can be seen in the drawings, the isolation device can be a ball 30. As depicted in FIG. 2, the isolation device can comprise the first material 51, the second material 52, and the electrolytic compound 53. According to this embodiment, the first and second materials 51/52 and the electrolytic compound 53 can be nuggets of material or a powder. Although this embodiment depicted in FIG. 2 illustrates the isolation device as a ball, it is to be understood that this embodiment and discussion thereof is equally applicable to an isolation device that is a bridge plug, packer, etc. The first material 51, the second material 52, and the electrolytic compound 53 can be bonded together in a variety of ways, including but not limited to powder metallurgy, in order to form the isolation device. At least a portion of the outside of the nuggets of the first material 51 can be in direct contact with at least a portion of the outside of the nuggets of the second material 52. By contrast, the outside of the nuggets of the first material 51 do not have to be in direct contact with the outside of the nuggets of the second material 52. For example, the electrolytic compound 53 can be an intermediary substance located between the outsides of the nuggets of the first and second materials 51/52. In order for galvanic corrosion to occur (and hence dissolution of at least a portion of the first material 51), both, the first and second materials 51/52 need to be capable of being contacted by the electrolyte. If the wellbore contains a fluid that is an electrolyte, then preferably, at least a portion of one or more nugget of the first material 51 and the second material 52 form the outside of the isolation device, such as a ball 30. In this manner, at least a portion of the first and second materials 51/52 are capable of being contacted with the electrolyte wellbore fluid. In the event the wellbore fluid is not an electrolyte, then preferably, the electrolytic compound 53 also forms the outside of the isolation device. In this manner, the electrolytic compound 53 can dissolve in a fluid located within the wellbore to form free ions (e.g., an electrolyte).

The size, shape and placement of the nuggets of the first and second materials 51/52 can be adjusted to control the rate of dissolution of the first material 51. By way of example, generally the smaller the cross-sectional area of each nugget, the faster the rate of dissolution. The smaller cross-sectional area increases the ratio of the surface area to total volume of the material, thus allowing more of the material to come in contact with the electrolyte. The cross-sectional area of each nugget of the first material 51 can be the same or different, the cross-sectional area of each nugget of the second material 52 can be the same or different, and the cross-sectional area of the nuggets of the first material 51 and the nuggets of the second material 52 can be the same or different. Additionally, the cross-sectional area of the nuggets forming the outer portion of the isolation device and the nuggets forming the inner portion of the isolation device can be the same or different. By way of example, if it is desired for the outer portion of the isolation device to proceed at a faster rate of galvanic corrosion compared to the inner portion of the device, then the cross-sectional area of the individual nuggets comprising the outer portion can be smaller compared to the cross-sectional area of the nuggets comprising the inner portion. The shape of the nuggets of the first and second materials 51/52 can also be adjusted to allow for a greater or smaller cross-sectional area. The proximity of the first material 51 to the second material 52 can also be adjusted to control the rate of dissolution of the first material 51. According to an embodiment, the first and second materials 51/52 are within 2 inches, preferably less than 1 inch of each other.

FIGS. 3 and 4 depict the isolation device according to other embodiments. As can be seen in FIG. 3, the isolation device, such as a ball 30, can be made of the first material 51. The electrolytic compound 53 can be a layer that coats the outside of the first material 51. There can also be multiple layers of the first material 51 and the electrolytic compound 53, wherein the first material and the electrolytic compound can be the same or different for each layer. As can be seen in FIG. 4, the second material 52 can coat the electrolytic compound 53 and the first material 51 can coat the second material 52. This embodiment may be useful when the wellbore fluid is an electrolyte. In this manner, the first material 51 and second material 52 can start to dissolve, thereby exposing the electrolytic compound 53. The electrolytic compound 53 can then dissolve in the wellbore fluid to increase the concentration of free ions available in the electrolyte fluid. At least a portion of a seat 40 can comprise the second material 52. According to this embodiment, at least a portion of the first material 51 of the ball 30 can come in contact with at least a portion of the second material 52 of the seat 40. Although not shown in the drawings, according to another embodiment, at least a portion of a tubing string can comprise the second material 52. This embodiment can be useful for a ball, bridge plug, packer, etc. isolation device. Preferably, the portion of the tubing string that comprises the second material 52 is located adjacent to the isolation device comprising the first material 51. More preferably, the portion of the tubing string that comprises the second material 52 is located adjacent to the isolation device comprising the first material 51 after the isolation device is situated in the desired location within the wellbore 11. The portion of the tubing string that comprises the second material 52 is preferably located within a maximum distance to the isolation device comprising the first material 51. The maximum distance can be a distance such that an electrically conductive path exists between the first material 51 and the second material 52. In this manner, once the isolation device is situated within the wellbore 11 and the first and second materials 51/52 are in contact with the electrolyte, at least a portion of the first material 51 is capable of dissolving due to the electrical connectivity between the materials.

According to an embodiment, at least the first material 51 is capable of withstanding a specific pressure differential (for example, the isolation device depicted in FIG. 3). As used herein, the term "withstanding" means that the substance does not crack, break, or collapse. The pressure differential can be the downhole pressure of the subterranean formation 20 across the device. As used herein, the term "downhole" means the location of the wellbore where the first material 51 is located. Formation pressures can range from about 1,000 to about 30,000 pounds force per square inch (psi) (about 6.9 to about 206.8 megapascals "MPa"). The pressure differential can also be created during oil or gas operations. For example, a fluid, when introduced into the wellbore 11 upstream or downstream of the substance, can create a higher pressure above or below, respectively, of the isolation device. Pressure differentials can range from 100 to over 10,000 psi (about 0.7 to over 68.9 MPa). According to another embodiment, both, the first and second materials 51/52 are capable of withstanding a specific pressure differential (for example, the isolation device depicted in FIG. 2).

As discussed above, the rate of dissolution of the first material 51 can be controlled using a variety of factors.

According to an embodiment, at least the first material 51 includes one or more tracers (not shown). The tracer(s) can be, without limitation, radioactive, chemical, electronic, or acoustic. The second material 52 and/or the electrolytic compound 53 can also include one or more tracers. As depicted in FIG. 2, each nugget of the first material 51 can include a tracer. At least one tracer can be located near the outside of the isolation device and/or at least one tracer can be located near the inside of the device. Moreover, at least one tracer can be located in multiple layers of the device. A tracer can be useful in determining real-time information on the rate of dissolution of the first material 51. For example, a first material 51 containing a tracer, upon dissolution can be flowed through the wellbore 11 and towards the wellhead or into the subterranean formation 20. By being able to monitor the presence of the tracer, workers at the surface can make on-the-fly decisions that can affect the rate of dissolution of the remaining first material 51.

The electrolytic compound 53 dissolves in a fluid located within the wellbore (i.e., the wellbore fluid) to form free ions that are electrically conductive. Prior to contact with the wellbore fluid, the electrolytic compound 53 will be inert and will not degrade the isolation device. According to an embodiment, the wellbore fluid is an electrolyte and the free ions formed increase the concentration of the free ions in the electrolyte. This embodiment is useful when the wellbore fluid is a brine or seawater or otherwise already contains free ions available to initiate the galvanic reaction between the first material 51 and the second material 52. According to this embodiment, the concentration of free ions available in the electrolyte wellbore fluid can be reduced to such a low concentration that the galvanic reaction stops or the reaction slows to an undesirable rate. Therefore, the free ions formed from the dissolution of the electrolytic compound 53 in the wellbore fluid increases the concentration of free ions available to either maintain the galvanic reaction or increase the reaction rate.

According to another embodiment, the wellbore fluid does not contain a sufficient amount of free ions to initiate the galvanic reaction between the first material 51 and the second material 52. According to this embodiment, the electrolytic compound 53 dissolves in the wellbore fluid to form an electrolyte. The free ions formed are now available to initiate the galvanic reaction. Subsequent dissolution of the electrolytic compound 53 can maintain the galvanic reaction or increase the rate of the reaction.

The electrolytic compound 53 is preferably soluble in the fluid located within the wellbore. The wellbore fluid can comprise, without limitation, freshwater, brackish water, saltwater, and any combination thereof. As stated above, the wellbore fluid can contain free ions in which the fluid is an electrolyte or it may not contain a sufficient amount of free ions to function as an electrolyte. According to an embodiment, the electrolytic compound 53 is a water-soluble acid, base, or salt. The water-soluble salt can be a neutral salt, an acid salt, a basic salt, or an alkali salt. As used herein, an "acid salt" is a compound formed from the partial neutralization of a diprotic or polyprotic acid, and a "basic salt" and "alkali salt" are compounds formed from the neutralization of a strong base and a weak acid, wherein the base of the alkali salt is an alkali metal or alkali earth metal. Preferably, the water-soluble salt is selected from the group consisting of sodium chloride, sodium bromide, sodium acetate, sodium sulfide, sodium hydrosulfide, sodium bisulfate, monosodium phosphate, disodium phosphate, sodium bicarbonate, sodium percarbonate, calcium chloride, calcium bromide, calcium bicarbonate, potassium chloride, potassium bromide, potassium nitrate, potassium metabisulphite, magnesium chloride, cesium formate, cesium acetate, alkali metasilicate, and any combination thereof. Common free ions in an electrolyte or formed from dissolution include, but are not limited to, sodium ($Na^+$), potassium ($K^+$), calcium ($Ca^{2+}$), magnesium ($Mg^{2+}$), chloride ($Cl^-$), hydrogen phosphate ($HPO_4^{2-}$), and hydrogen carbonate ($HCO_3^-$). An acid salt, basic salt, or alkali salt may be useful when it is desirable to buffer the pH of the wellbore fluid. For example, during galvanic corrosion, the wellbore fluid may become undesirably acidic or basic. The electrolytic compound, once dissolved in the wellbore fluid, can then bring the pH to a desirable value.

Another factor that can affect the rate of dissolution of the first material 51 is the concentration of free ions and the temperature of the electrolyte. Generally, the higher the concentration of the free ions, the faster the rate of dissolution of the first material 51, and the lower the concentration of the free ions, the slower the rate of dissolution. Moreover, the higher the temperature of the electrolytic fluid, the faster the rate of dissolution of the first material 51, and the lower the temperature of the electrolytic fluid, the slower the rate of dissolution. One of ordinary skill in the art can select: the exact metals and/or metal alloys, the proximity of the first and second materials, and the concentration of the electrolytic compound 53 based on an anticipated temperature in order for the at least a portion of the first material 51 to dissolve in the desired amount of time.

It may be desirable to control the rate of dissolution of the first material 51 due to galvanic corrosion using the electrolytic compound 53. According to an embodiment, the concentration of the electrolytic compound 53 within the isolation device 30 is selected such that the at least a portion of the first material 51 dissolves in the desired amount of time. If more than one type of electrolytic compound 53 is used, then the exact electrolytic compound and the concentration of each electrolytic compound are selected such that the first material 51 dissolves in a desired amount of time. The concentration can be determined based on at least the specific metals or metal alloys selected for the first and second materials 51/52 and the bottomhole temperature of the well. The location of the electrolytic compound 53 within the isolation device and concentration at each location can be adjusted to control the rate of dissolution of the first material 51. By way of example, with reference to FIG. 2, the nuggets of the electrolytic compound 53 located closer to the perimeter of the isolation device 30 can be smaller (or larger depending on the desired initial reaction rate) than the nuggets of electrolytic compound 53 located closer to the center of the isolation device 30. In this manner, as the first material 51 dissolved due to galvanic corrosion, different concentrations of electrolytic compound are exposed to provide the desired reaction rate and dissolution of the first material in the desired amount of time. Another example, with reference to FIG. 3, is the thickness of the electrolytic compound 53 layer(s) can be selected to provide the desired concentration of free ions once dissolved in the wellbore fluid. It is to be understood that when discussing the concentration of an electrolyte, it is meant to be a concentration prior to contact with either the first and second materials 51/52, as the concentration will decrease during the galvanic corrosion reaction.

The methods include placing the isolation device into the wellbore 11. More than one isolation device can also be placed in multiple portions of the wellbore. The methods can further include the step of removing all or a portion of the dissolved first material 51 and/or all or a portion of the second material 52, wherein the step of removing is performed after the step of allowing the at least a portion of the first material to dissolve. The step of removing can include flowing the dissolved first material 51 and/or the second material 52 from the wellbore 11. According to an embodiment, a sufficient amount of the first material 51 dissolves such that the isolation device is capable of being flowed from the wellbore 11. According to this embodiment, the isolation device should be capable of being flowed from the wellbore via dissolution of the first material 51, without the use of a milling apparatus, retrieval apparatus, or other such apparatus commonly used to remove isolation devices. According to an embodiment, after dissolution of the first material 51 and/or the second material 52 has a cross-sectional area less than 0.05 square inches, preferably less than 0.01 square inches.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of removing a wellbore isolation device comprising:

placing the wellbore isolation device into the wellbore, wherein the isolation device comprises:

a first material, wherein the first material:

(A) is a metal or a metal alloy; and (B) partially dissolves when an electrically conductive path exists between the first material and a second material and at least a portion of the first and second materials are in contact with an electrolyte;

the second material; and an electrolytic compound, wherein the electrolytic compound dissolves in a fluid located within the wellbore to form free ions that are electrically conductive, wherein the second material coats the electrolytic compound, and the first material coats the second material; and allowing at least a portion of the first material to dissolve.

2. The method according to claim 1, wherein the isolation device is capable of restricting or preventing fluid flow between a first zone and a second zone of the wellbore.

3. The method according to claim 1, wherein isolation device is a ball and a seat, a plug, a bridge plug, a wiper plug, or a packer.

4. The method according to claim 1, wherein the metal or metal of the metal alloy of the first material and the second material are selected from the group consisting of, beryllium, tin, iron, nickel, copper, zinc, and combinations thereof.

5. The method according to claim 1, wherein the isolation device further comprises the second material.

6. The method according to claim 1, wherein the fluid located within the wellbore comprises freshwater, brackish water, saltwater, and any combination thereof.

7. The method according to claim 1, wherein the fluid located within the wellbore is the electrolyte and the free ions formed increases the concentration of free ions in the electrolyte.

8. The method according to claim 1, wherein the electrolytic compound is a water-soluble acid, base, or salt.

9. The method according to claim 8, wherein the water-soluble salt is a neutral salt, an acid salt, a basic salt, or an alkali salt.

10. The method according to claim 9, wherein the water-soluble salt is selected from the group consisting of sodium chloride, sodium bromide, sodium acetate, sodium sulfide, sodium hydrosulfide, sodium bisulfate, monosodium phosphate, disodium phosphate, sodium bicarbonate, sodium percarbonate, calcium chloride, calcium bromide, calcium bicarbonate, potassium chloride, potassium bromide, potassium nitrate, potassium metabisulphite, magnesium chloride, cesium formate, cesium acetate, alkali metasilicate, and any combination thereof.

11. The method according to claim 1, wherein the concentration of the electrolytic compound within the isolation device is selected such that the at least a portion of the first material dissolves in a desired amount of time.

12. The method according to claim 1, wherein the location of the electrolytic compound within the isolation device and concentration at each location is adjusted to control the rate of dissolution of the first material.

13. The method according to claim 1, wherein the step of allowing allows all of the first material to dissolve.

* * * * *